US011246370B2

(12) United States Patent
Brooks

(10) Patent No.: US 11,246,370 B2
(45) Date of Patent: Feb. 15, 2022

(54) COWBOY HAT WITH INTERIOR HEAD PROTECTION

(71) Applicant: Crown Holdings Management, LLC, Weatherford, TX (US)

(72) Inventor: John W. Brooks, Lipan, TX (US)

(73) Assignee: Crown Holdings Management, LLC, Weatherford, TX (US)

( * ) Notice: Subject to any disclaimer, the term of this patent is extended or adjusted under 35 U.S.C. 154(b) by 111 days.

(21) Appl. No.: 16/691,857

(22) Filed: Nov. 22, 2019

(65) Prior Publication Data

US 2021/0153593 A1 May 27, 2021

(51) Int. Cl.
*A42B 3/14* (2006.01)
*A42B 1/02* (2006.01)
*A42B 3/08* (2006.01)

(52) U.S. Cl.
CPC ..... *A42B 3/145* (2013.01); *A42B 1/02* (2013.01); *A42B 3/08* (2013.01)

(58) Field of Classification Search
CPC .. A42B 3/14; A42B 3/145; A42B 3/08; A42B 1/02
See application file for complete search history.

(56) References Cited

U.S. PATENT DOCUMENTS 4,942,628 A * 7/1990 Freund ..... A42B 3/145 2/410
5,898,949 A * 5/1999 Barthold ..... A42B 3/10 2/416
5,950,245 A * 9/1999 Binduga ..... A42B 3/145 2/417
6,032,297 A * 3/2000 Barthold ..... A42B 3/10 2/416
6,298,249 B1 * 10/2001 Locarno ..... A42B 3/14 2/417
6,314,588 B1 * 11/2001 Fang ..... A42B 3/145 2/183
6,332,227 B1 * 12/2001 Fang ..... A42B 3/145 2/183
7,174,575 B1 * 2/2007 Scherer ..... A42B 3/145 2/418
8,161,576 B2 * 4/2012 Lemke ..... A42B 3/145 2/418
2006/0015986 A1 * 1/2006 Bielefeld ..... A42B 3/145 2/181
2011/0072547 A1 * 3/2011 Doria ..... F41H 1/08 2/2.5
2017/0290389 A1 * 10/2017 Copeland ..... A42B 3/32

OTHER PUBLICATIONS

Internet webpage advertisement "Resistol Ridesafe": https://resistol.com/pages/resistol-ridesafe?gclid=CjwKCAiAob3vBRAUEiwAlbs5TjtyfWSjejldwrziQZhwtMD7jmeBfLJ3NCDedoJXxAa94GSzvrohVRoCxnlQAvD_BwE.

* cited by examiner

*Primary Examiner* — Tajash D Patel
(74) *Attorney, Agent, or Firm* — James E. Walton

(57) ABSTRACT

A cowboy hat with interior head protection includes a hat, a helmet shell attached to the interior of the hat, and a ratchet adjustment assembly coupled to the helmet shell, wherein the helmet shell is substantially concealed within the interior of the hat.

20 Claims, 10 Drawing Sheets

COWBOY HAT WITH INTERIOR HEAD PROTECTION

BACKGROUND

1. Field of the Invention

The present invention relates in general to the field of head protection.

2. Description of Related Art

Equestrian and rodeo sports are inherently unsafe. A fall from an animal can happen at any time and can quickly become a nightmare scenario. Wearing a helmet is an easy way to prevent serious head injuries during such a fall. For many equestrian and rodeo participants, however, wearing a traditional helmet is not desirable because it signifies weakness and does not allow the participant to properly represent the sport's western heritage by wearing a cowboy hat. Although wearing a helmet has been shown to significantly reduce the likelihood of a serious head injury, equestrian and rodeo athletes will often forego wearing a helmet, if it does not appear to be traditional western attire.

FIGS. 1-3 show perspective, bottom and rear views of a prior-art cowboy hat helmet 100 comprising a hat 101 and a helmet system 103. The helmet system 103 is bulky and conspicuous from the outside of hat 101. Helmet system comprises a rigid ABS shell 105, an EPS foam crown 107, a lower guard 109, adjustment system 111 and retention system 113. Rigid ABS shell 105 protrudes through hat 101 and is visible above the entire brim of hat 101. EPS foam crown 107 is a high impact foam that covers the interior of hat 101 and is in direct contact with the user's head. Lower guard 109 is a high density shell and foam that extends from EPS foam crown 107 and bulges out from underneath hat 101 to provide protection for the lower back of the head. Adjustment system 111 expands from lower guard 109 and allows the user to adjust the size of the helmet accordingly. Retention system 113 connects the lower guard 109 to hat 101 and allows the user to adjust chin strap 115 to ensure a proper fit.

Cowboy hat helmet 100 provides head protection for equestrian and rodeo athletes, but the rigid ABS shell 105 is bulky on the outside of hat 101 and the lower guard 109 protrudes out significantly from under hat 101, which makes the cowboy hat helmet 100 look more like a helmet than a cowboy hat. Thus, there exists significant room for improvement in the art for overcoming these and other shortcomings of head protection for equestrian and rodeo athletes.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
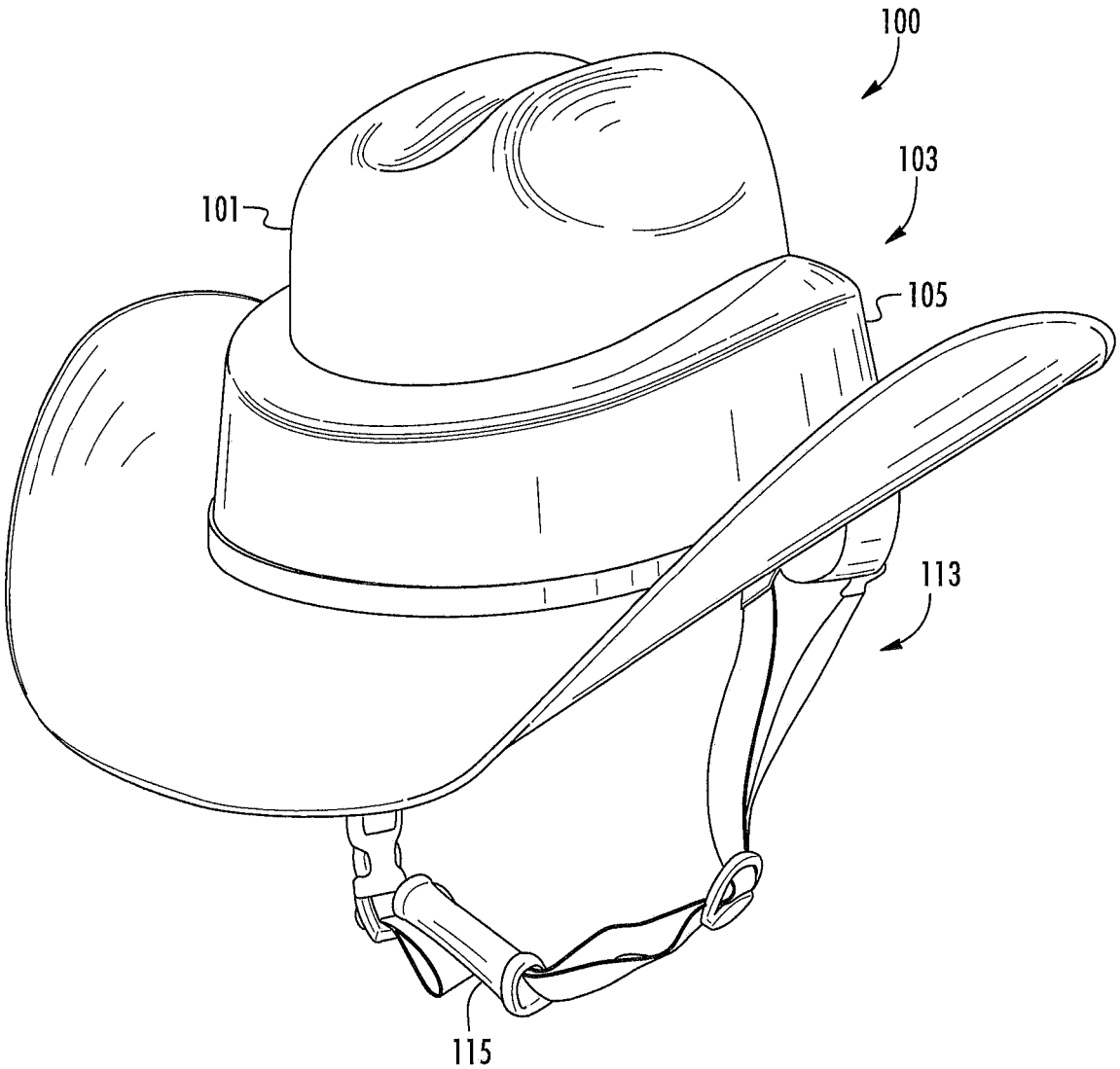
FIG. 1 PRIOR ART
FIG. 1 is a perspective view of a conventional equestrian and rodeo helmet.
Figure 2:
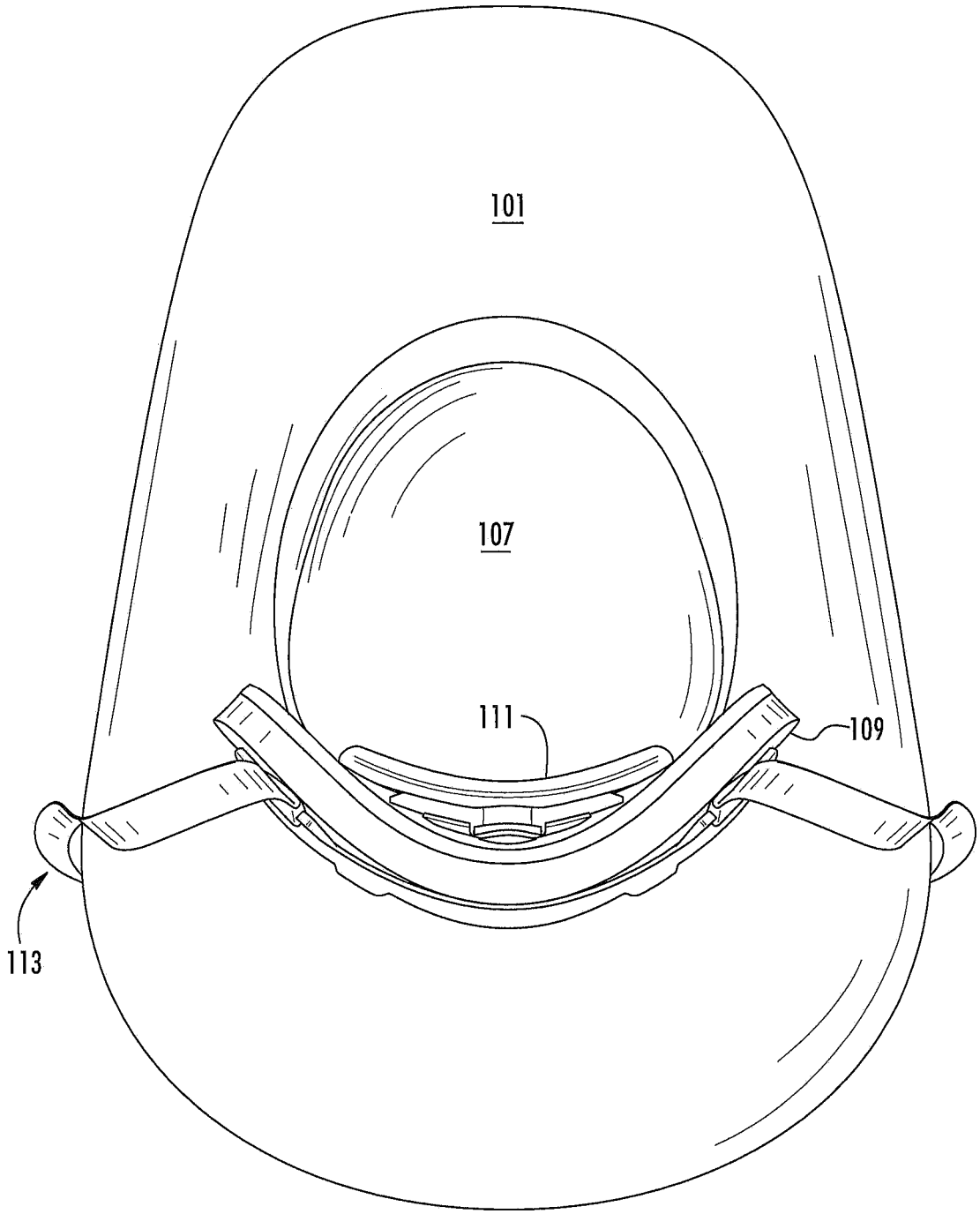
FIG. 2 PRIOR ART
FIG. 2 is a bottom view of the conventional equestrian and rodeo helmet of FIG. 1.
Figure 3:
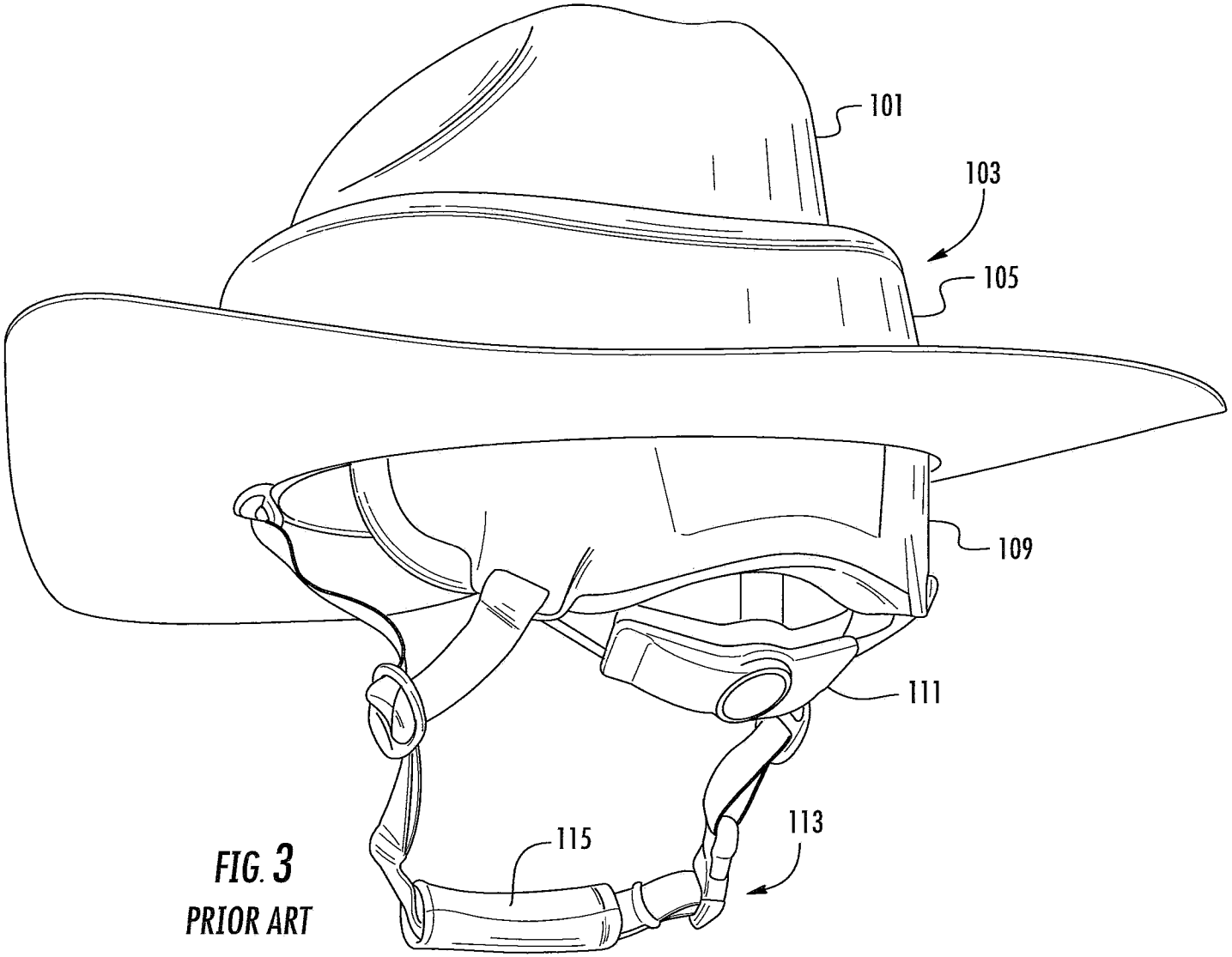
FIG. 3 PRIOR ART
FIG. 3 is a rear view of the conventional equestrian and rodeo helmet of FIG. 1.

While the assembly of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the cowboy hat with interior head protection are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 4:
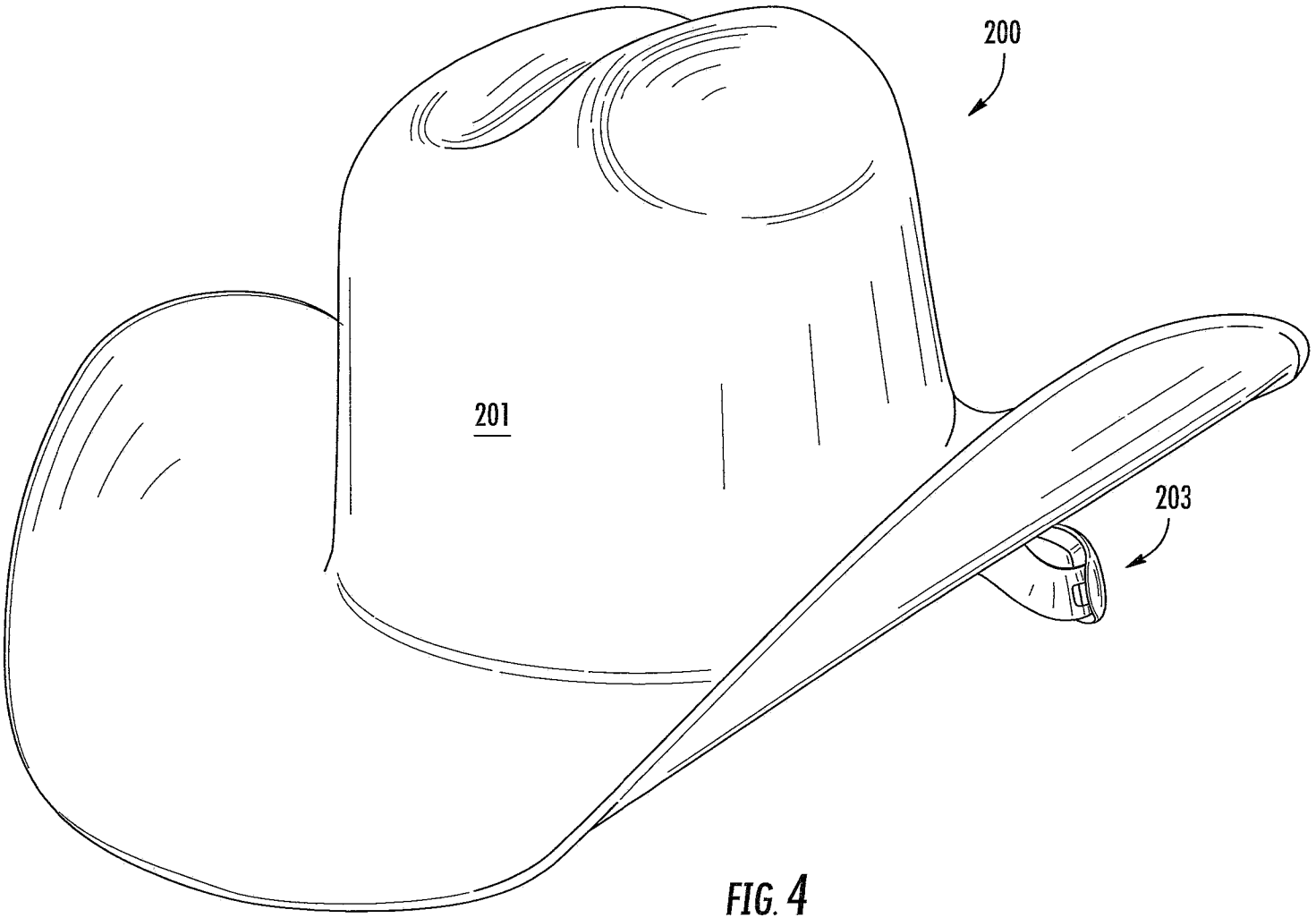
FIG. 4 a perspective view of the improved equestrian and rodeo helmet according to the present application.
Figure 5:
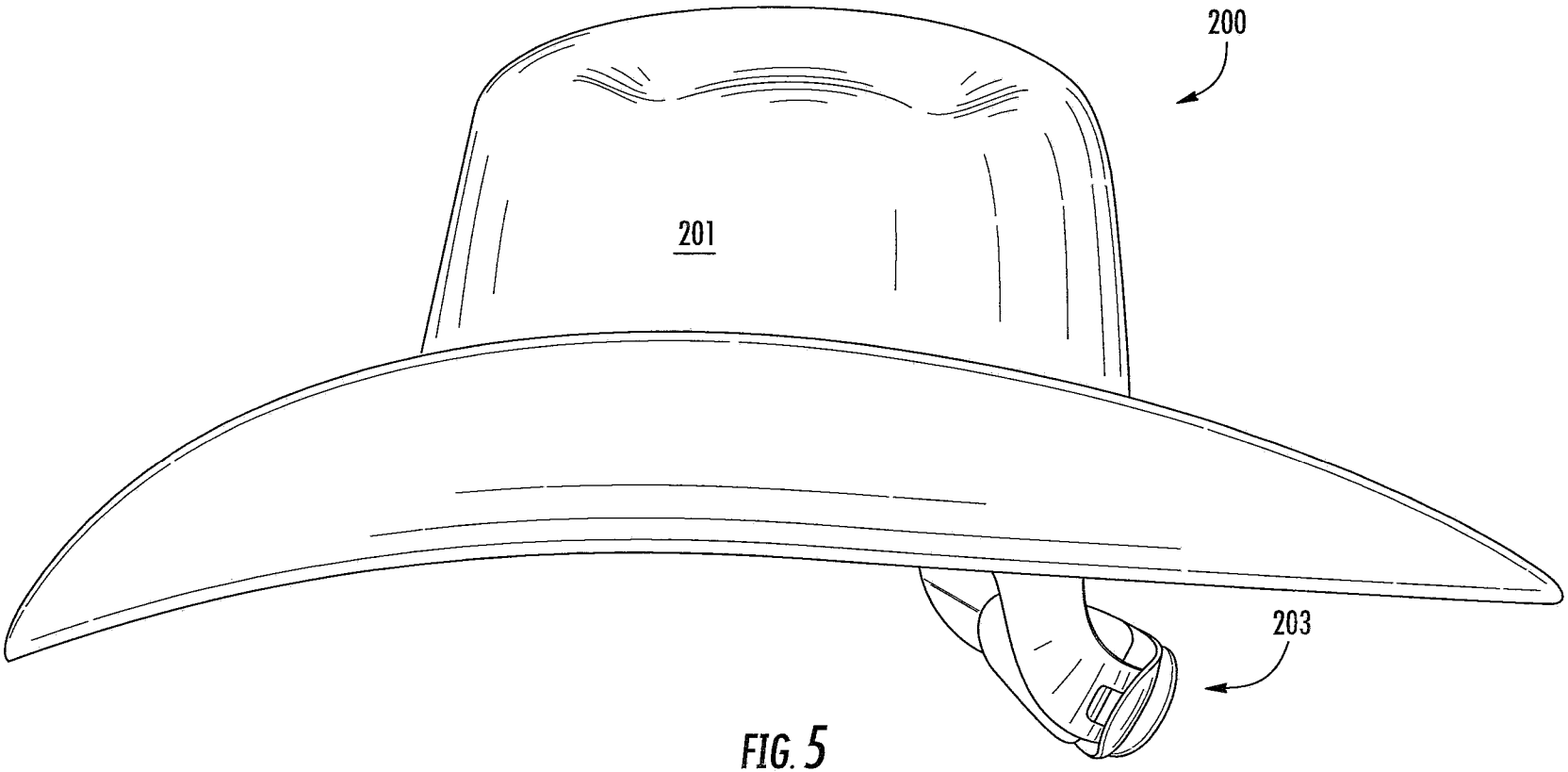
FIG. 5 a side view of the improved equestrian and rodeo helmet of FIG. 4.
Figure 6:
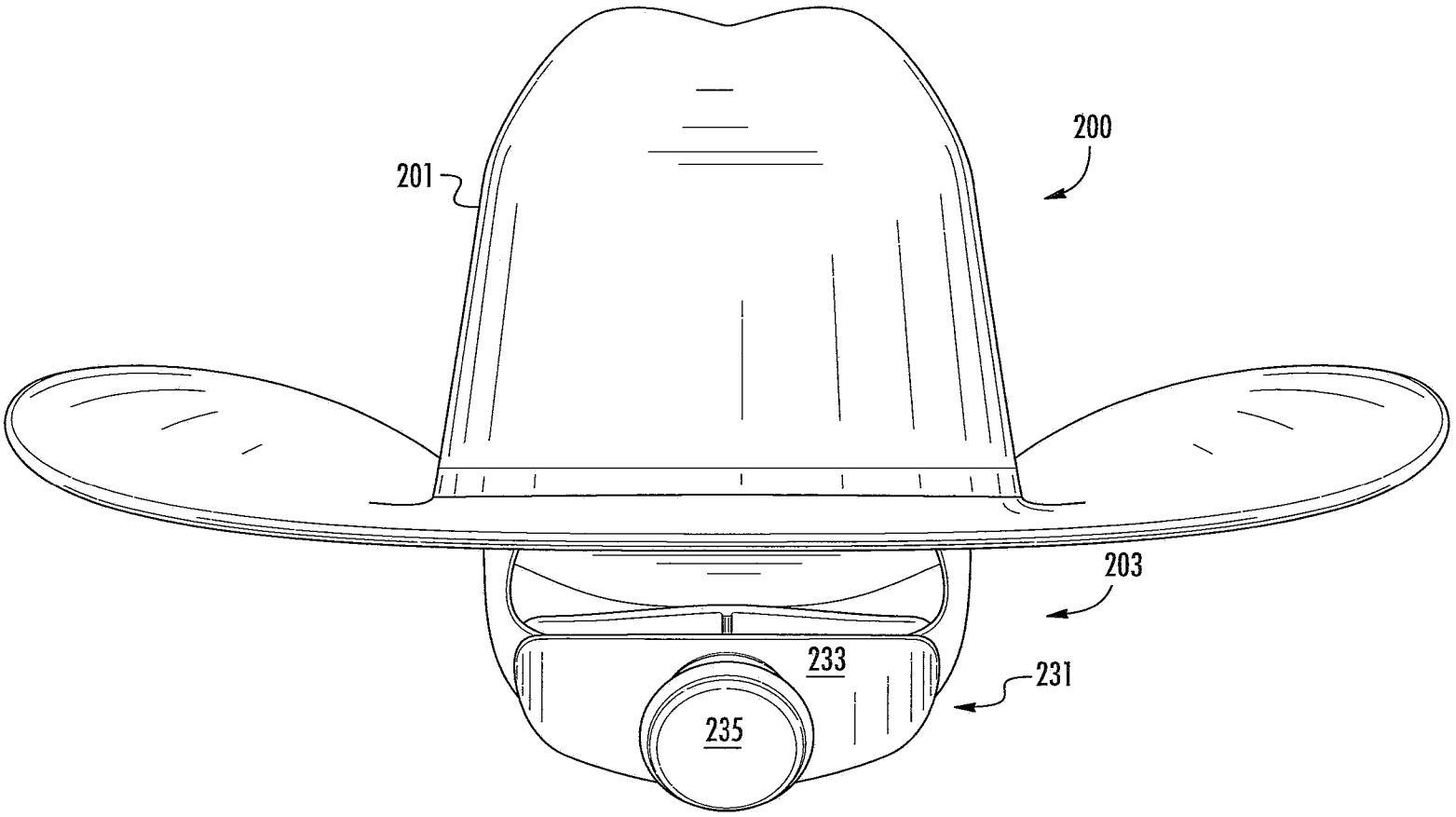
FIG. 6 is a rear view of the improved equestrian and rodeo helmet of FIG. 4.

Referring to FIGS. 4-6 in the drawings, a preferred embodiment of a cowboy hat with interior head protection 200 according to the present application is illustrated. Cowboy hat with interior head protection 200 comprises cowboy hat 201 and helmet assembly 203. From the outside of cowboy hat 201, it is difficult to distinguish cowboy hat 201 from any other traditional cowboy hat without interior head protection. Helmet assembly 203 is barely visible from a side view as shown in FIG. 5 and only slightly more visible from a rear view as shown in FIG. 6. Specifically, only ratchet adjustment assembly 231 is visible from the side and rear views.

Figure 8:
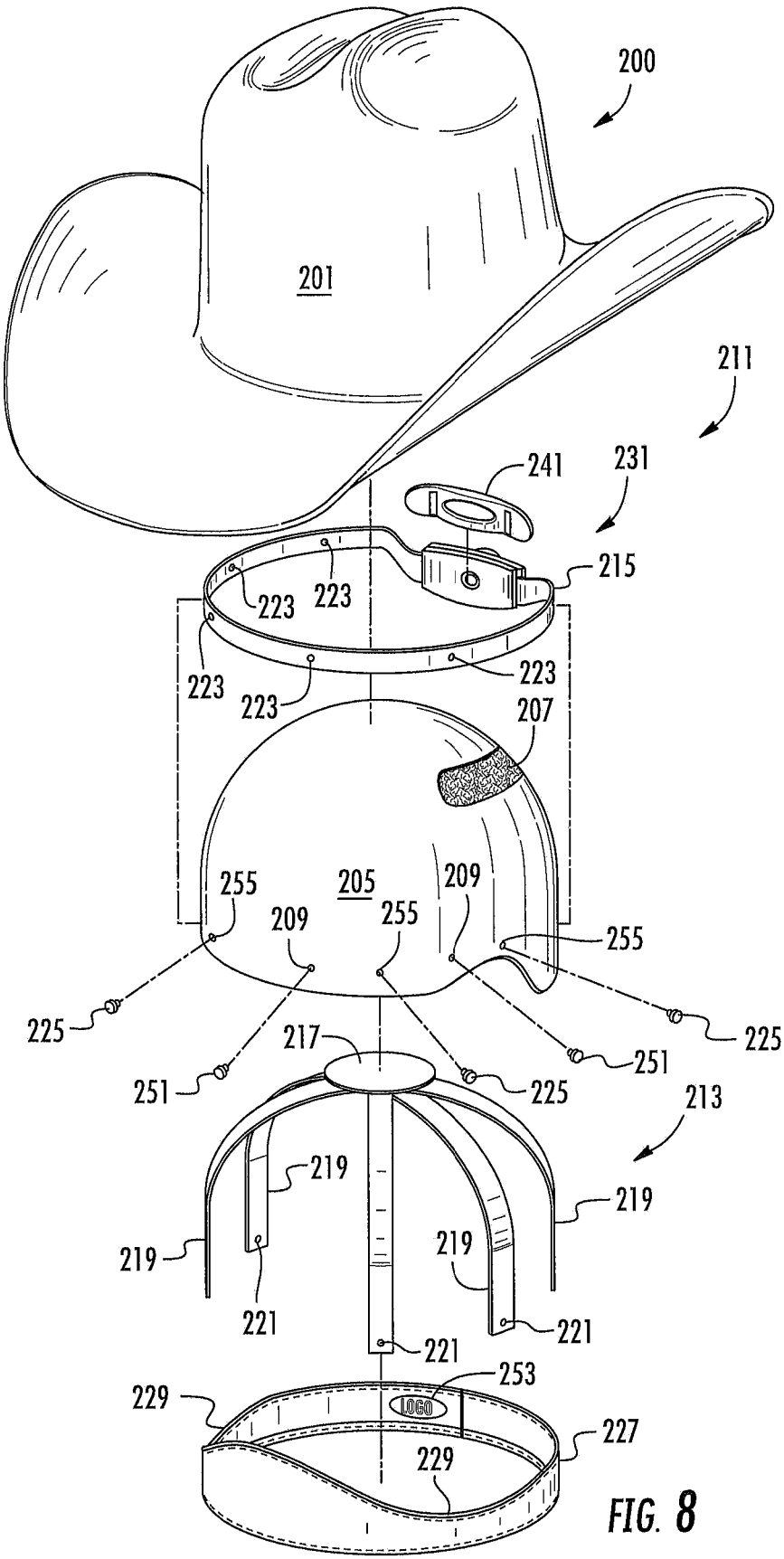
FIG. 8 is an exploded view of the improved equestrian and rodeo helmet of FIG. 4.

Referring now also to FIG. 8 in the drawings, an exploded view of a preferred embodiment of a cowboy hat with interior head protection 200 according to the present application is illustrated. Cowboy hat 201 and helmet assembly 203 are releasably attached to each other using adhesive tape 207, preferably hook and loop tape. The use of adhesive tape 207 allows helmet assembly 203 to be removed from cowboy hat 201 and placed into any other cowboy hat, such as a rodeo athlete's lucky cowboy hat, or for cleaning purposes. In some cases, helmet assembly 203 may be permanently attached to cowboy hat 201. The helmet assembly may come in a variety of sizes such as youth, adult, one size fits all and/or sized (small, medium, large, etc.). It should be understood that additional foam may be placed between cowboy hat 201 and helmet assembly 203 for additional protection.

Helmet assembly 203 comprises a helmet shell 205, a ratchet adjustment assembly 211 and a headband cover 227. Helmet shell 205 is made of a high impact polystyrene and is shaped to cover the equestrian or rodeo athlete's skull to provide the maximum amount of head protection. Helmet rivet holes 209 are placed around the edge of helmet shell 205 to secure ratchet adjustment assembly 211 to the exterior of helmet shell 205 with rivets 225 or other suitable fasteners, such as screws, bolts, tabs, adhesives, and/or clips. Although ratchet adjustment assembly 211 is shown to extend all the way around helmet shell 205, it should be understood that ratchet adjustment assembly 211 may extend only partially around helmet shell 205. In addition, ratchet adjustment assembly 211 may be integrated with helmet shell 205, rather than coupled to helmet shell 205 using helmet rivet holes 209 and rivets 225. In some embodiments, foam may be added to the interior of helmet shell 205 for added comfort and/or protection. In other embodiments, other comfort and protection features may be added to the interior of helmet shell 205, such as gel packs, inflatable pads, heating packs, ice packs, etc. These comfort and protection features would be easily swapped depending on the needs of the athlete.

Ratchet adjustment assembly 211 is used to adjust the size of the helmet to fit the athlete's head and comprises cradle assembly 213, ratchet adjustment headband 215, ratchet tuning assembly 231 and ratchet back cover 241. Cradle assembly 213 comprises hub 217 and three flexible straps 219. Straps 219 are preferably made of a nylon material and pass through, but are not attached to, hub 217 to create the web-like structure in cradle assembly 213 and allow straps 219 to freely tighten and loosen as ratchet adjustment system 211 tightens and loosens. Hub 217 is loose, so that the athlete can adjust the position of hub 217 for the best fit. In some cases, hub 217 may include a piece of foam for added comfort and/or protection.

Straps 219 are used attach cradle assembly 213 to helmet shell 205 over the athlete's head. Straps 219 are attached to the interior of helmet shell 205 through webbing rivet holes 221 and helmet rivet holes 255, which are placed around the edge of helmet shell 205, with rivets 251. Although three straps 219 are shown, it should be understood that cradle assembly 213 may include more or less straps 219 to achieve the desired fit. In other embodiments, straps 219 may be looped through slots around the edge of helmet shell 205, folded over and stitched for added strength. In certain embodiments, straps 219 may be looped through slots in the ratchet adjustment headband 215 or riveted through the same rivet holes 223 that are used to attach ratchet adjustment headband 215 to helmet shell 205. In some embodiments, straps 219 may be attached to both helmet shell 205 and ratchet adjustment headband 215.

Ratchet adjustment headband 215 also has rivet holes 223 for use in attaching ratchet adjustment assembly 211 to helmet shell 205. Rivets 225 are inserted through rivet holes 223 and then through rivet holes 209 to secure ratchet adjustment assembly 211 to the outside of helmet shell 205. After ratchet adjustment assembly 211 is secured to helmet shell 205, headband cover 227 is secured to the inside of helmet shell 205 so that headband cover 227 is contact with the athlete's head and to the outside of ratchet adjustment assembly 211, so that headband cover 227 is also in contact with cowboy hat 201. In other embodiments, ratchet adjustment headband 215 may be attached to the inside of helmet shell 205 and headband cover 227 can be secured to ratchet adjustment headband 215, so that headband cover 227 is in contact with the athlete's head and outer side of helmet shell 205, which is in contact with cowboy hat 201.

Headband cover 227 is preferably made of a stretch cloth, foam material, natural leather, synthetic leather, or layered combinations of such materials, for comfort and additional protection. In some cases, headband cover 227 may be made from special material for specific purposes, such as wicking, anti-sweat, anti-fungal, etc. Headband cover 227 covers the entire surface area of ratchet adjustment headband 215 that is in contact with the athlete's head. In some embodiments, headband cover 227 may include a logo or other indicia 253. Although headband cover 227 has been shown with selected portions having a reduced height, i.e., curves 229, it should be understood that headband cover 227 may have straight edges without any curves. The curves 229 are preferably located at specific locations around headband cover 227, such as near the temples of the cowboy's head, which reduce the gripping force of headband cover 227, thereby providing additional comfort.

Figure 7:
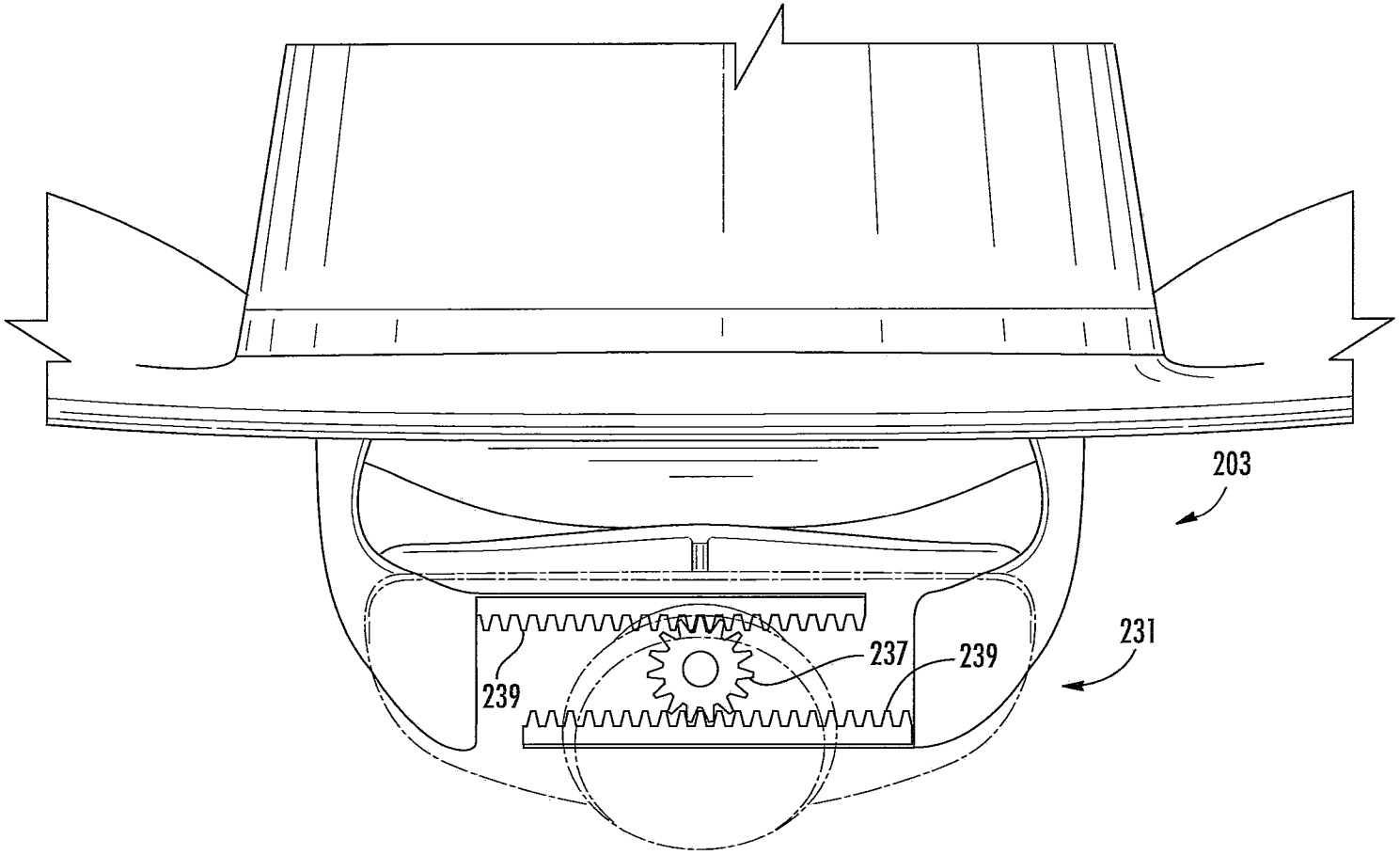
FIG. 7 is a rear view in partial section of the improved equestrian and rodeo helmet of FIG. 4.

Referring now also to FIG. 7 in the drawings, a rear view of cowboy hat with interior head protection 200 according to the present application is illustrated in partial section. Ratchet cover 233 and ratchet dial 235 are shown in phantom, so that pinion 237 and racks 239 are visible. Ratchet tuning assembly 231 is used for adjusting the helmet to provide the equestrian or rodeo athlete with a snug fit. Ratchet tuning assembly 231 preferably comprises a rack and pinion system, including a ratchet cover 233, a ratchet dial 235, a pinion 237 and one or more racks 239. Ratchet cover 233 covers pinion 237 and racks 239 to prevent interference with pinion 237 and racks 239. Ratchet dial 235 is used to tighten helmet assembly 203 to fit the athlete's head properly. When ratchet dial 235 is turned clockwise, pinion 237 and racks 239 ratchet forward making a clicking sound and ratchet tuning assembly 231 is pulled in to tighten around the athlete's head. When ratchet dial 235 is turned counterclockwise, pinion 237 and racks disengage to move backwards smoothly and ratchet tuning assembly is released and loosens around the athlete's head. In other embodiments, ratchet tuning assembly 231 may use other adjustment mechanisms, such as sliders, clips, snaps, and other suitable adjustment mechanisms for adjusting the helmet to provide the equestrian or rodeo athlete with a snug fit. Multiple mechanisms may work together to provide the proper fit adjustments. Ratchet tuning assembly 231 may also be coupled to the inside and/or outside of ratchet adjustment assembly 211.

Figure 9:
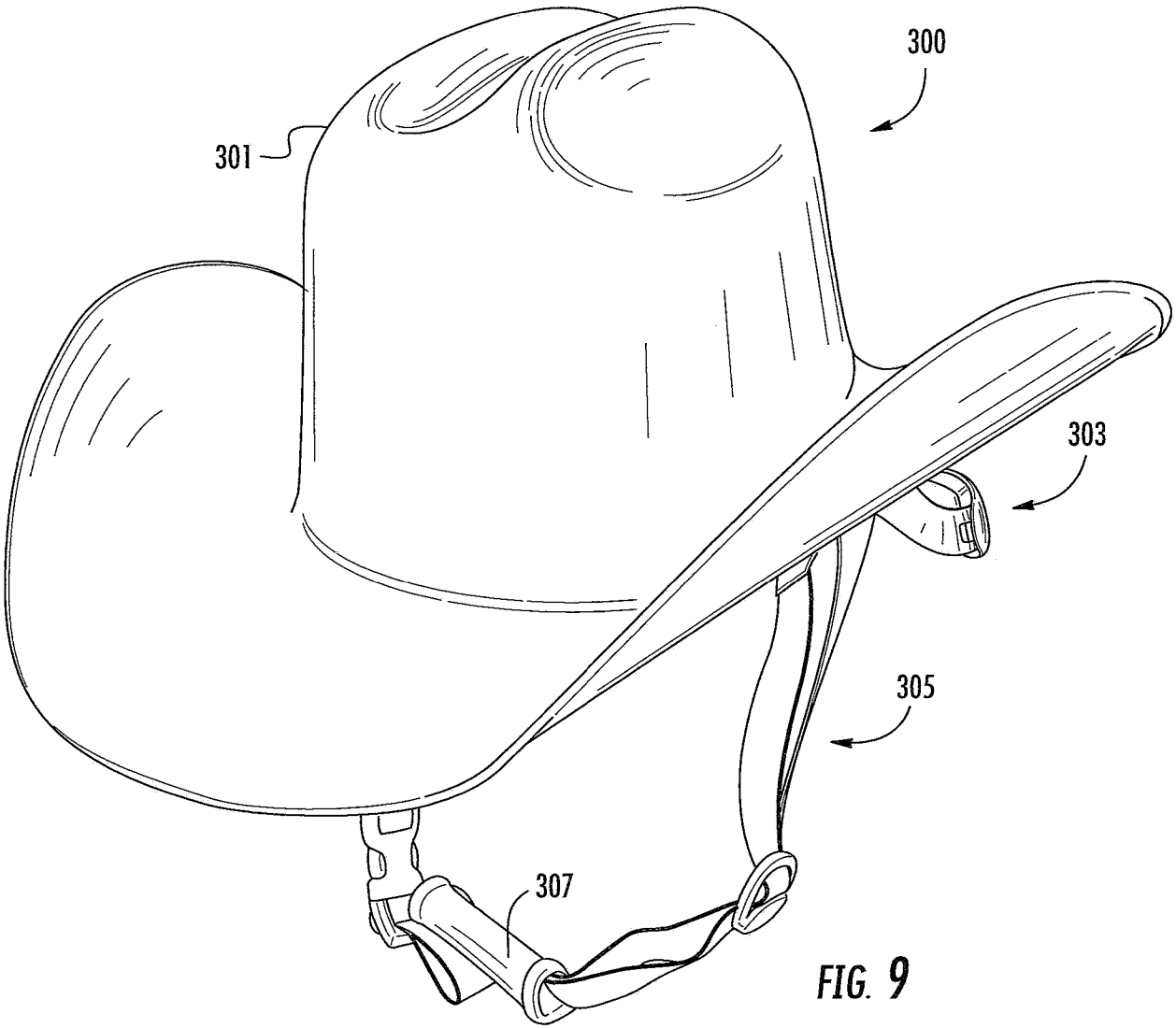
FIG. 9 is a perspective view of an alternative improved equestrian and rodeo helmet according to the present application.

Referring now also to FIG. 9 in the drawings, an alternative embodiment of a cowboy hat with interior head protection 300 according to the present application is illustrated. Cowboy hat with interior head protection 300 comprises cowboy hat 301, helmet assembly 303 and chin strap assembly 305. Cowboy hat 301 and helmet assembly 303 are similar to cowboy 201 and helmet assembly 203, respectively. Chin strap assembly 305 allows the athlete to further ensure a proper fit and comprises a chin strap pad 307. In some embodiments, chin strap pad 307 may be padded for additional comfort and safety. Chin strap assembly 305 is attached to helmet assembly 303. In the preferred embodiment, chin strap assembly 305 is releasably attached inside helmet assembly 203. For example, chin strap assembly 305 may be releasably attached to ratchet adjustment assembly 211, between ratchet adjustment assembly 211 and helmet shell 205, or between helmet shell 205 and cowboy hat 201. In some embodiments, chin strap assembly 305 is permanently attached rather than releasably attached to the inside of helmet assembly 203. In an alternative embodiment, chin strap assembly 305 passes through the cowboy hat 201 at either the brim or the band, and is entirely removable. In other embodiments, chin strap assembly 305 passes through the cowboy hat 201 at either the brim or the band, but is not removable.

Although FIGS. 4-9 depict a cowboy hat, it should be understood that the helmet assembly can be placed into any style of hat, including other western style hats, baseball caps, beanies, clown hats, etc. to allow a user to wear a helmet undetected.

Figure 10:
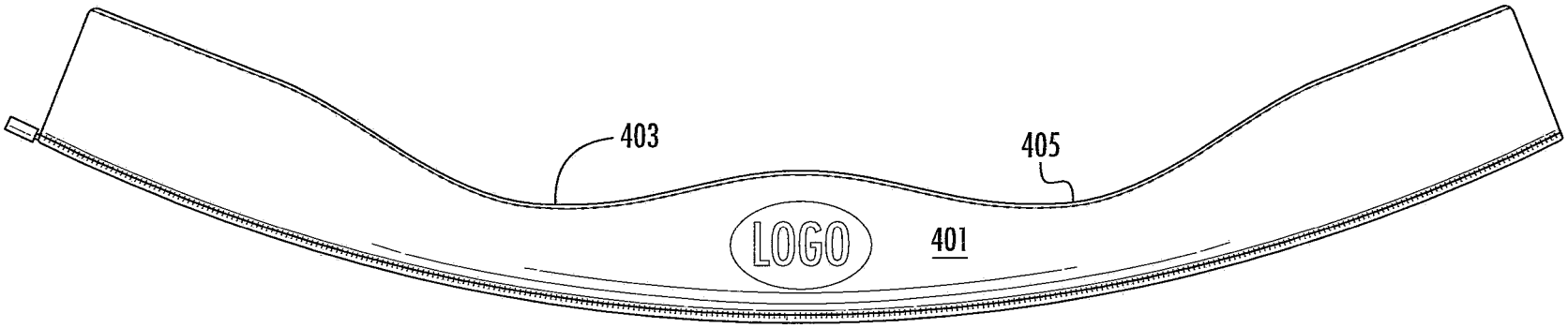
FIG. 10 is a perspective view of an alternative headband cover according to the present application.

Referring now also to FIG. 10 in the drawings, the preferred embodiment of a headband cover 401 according to the present application is illustrated. Headband cover 401 is similar to headband cover 227. Rather than having a straight edge along the top, headband cover 401 is curved downward at selected locations, such as at the athlete's temples, at curves 403 and 405. This unique configuration provides maximum gripping at the front and back of the athlete's head, and reduced gripping near the athlete's temples, thereby increasing protection and providing optimum comfort. Furthermore, many equestrian and rodeo athletes chew something, such as gum, sunflower seeds, or tobacco, while participating in their sport, and a headband cover over the temples leads to some discomfort. Since headband cover 401 has reduced gripping over the athlete's temples, the athlete can chew and wear headband cover 401 without any discomfort. In some embodiments, headband cover 401 may be made using multiple layers of material. For example, headband cover 401 may have a layer of animal skin, such as goat skin, that is in contact with the athlete's head, which is adhered to a layer of foam to provide additional comfort, which is then adhered to a layer of fabric that is in contact with the interior of the helmet shell. In some embodiments, headband cover 401 may be perforated or may be made from special material for specific purposes, such as wicking, anti-sweat, anti-fungal, etc.

It is apparent that an assembly with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A helmet, comprising:
a hat, comprising:
a brim; and
an upper portion extending up from the brim, the upper portion having an interior;
a helmet shell attached to the interior of the upper portion; and
a ratchet adjustment assembly coupled to the helmet shell;
wherein the helmet shell is disposed within the interior of the upper portion.

2. The helmet of claim 1, wherein the helmet shell is releasably attached to the interior of the upper portion.

3. The helmet of claim 1, wherein the ratchet adjustment assembly is permanently attached to the helmet shell.

4. The helmet of claim 1, wherein the ratchet adjustment assembly comprises:
a ratchet tuning assembly.

5. The helmet of claim 4, wherein the ratchet tuning assembly comprises:
a dial.

6. The helmet of claim 4, wherein the ratchet tuning assembly comprises:
a slider.

7. The helmet of claim 1, wherein the ratchet tuning assembly extends at least partially below the hat.

8. The helmet of claim 4, wherein the ratchet tuning assembly is attached to the back of the ratchet adjustment assembly.

9. The helmet of claim 4, wherein the ratchet tuning assembly comprises:
a single adjustment mechanism.

10. The helmet of claim 4, wherein the ratchet tuning assembly comprises:
multiple adjustment mechanisms.

11. The helmet of claim 4, wherein the ratchet tuning assembly is coupled to the inside and outside of the ratchet adjustment assembly.

12. The helmet of claim 4, wherein the ratchet tuning assembly is coupled only to outside of the ratchet adjustment assembly.

13. The helmet of claim 1, further comprising:
a cradle assembly disposed within the helmet shell.

14. The helmet of claim 1, further comprising:
a chin strap assembly coupled to the helmet shell.

15. The helmet of claim 14, wherein the chin strap assembly comprises:
a padded chin strap.

16. The helmet of claim 14, wherein the chin strap assembly is releasably coupled to the helmet shell.

17. The helmet of claim 14, wherein the chin strap assembly passes through the outside of the hat.

18. The helmet of claim 16, wherein the chin strap assembly is adjustable.

19. The helmet of claim 17, wherein the chin strap assembly is permanently attached to the helmet shell.

20. A helmet for use with a hat, comprising:
a helmet assembly, comprising:
a helmet shell;
a ratchet adjustment assembly coupled to the helmet shell; and
a ratchet tuning assembly coupled to the ratchet adjustment assembly;
wherein the helmet shell is disposed within the interior of the hat.

* * * * *